United States Patent [19]

Maurer

[11] Patent Number: 5,032,966

[45] Date of Patent: Jul. 16, 1991

[54] BULB AND REFLECTOR ASSEMBLY

[75] Inventor: Rene Maurer, Zumikon, Switzerland

[73] Assignee: NAFA Light Kurt Maurer, Inhaberin Frau M. Maurer-Werren, Zumikom, Switzerland

[21] Appl. No.: 511,279

[22] Filed: Apr. 24, 1990

[30] Foreign Application Priority Data

May 2, 1989 [DE] Fed. Rep. of Germany ..... 8905535

[51] Int. Cl.[5] ..... F21V 21/10

[52] U.S. Cl. ..... 362/429; 362/373

[58] Field of Search ..... 362/226, 263, 289, 373, 362/429

[56] References Cited

U.S. PATENT DOCUMENTS

| | | | |
|---|---|---|---|
| 1,825,641 | 9/1931 | Wolarsky | 362/429 |
| 2,095,353 | 10/1937 | White | 362/429 X |
| 2,673,287 | 3/1954 | Elmer | 362/429 |
| 4,363,086 | 12/1982 | Fletcher | 362/263 X |

*Primary Examiner*—Stephen F. Husar

*Attorney, Agent, or Firm*—Brady, O'Boyle & Gates

[57] ABSTRACT

The halogen bulb holder (3) of the light is held by a support that consists of two U-shaped profile parts (6, 7) at a distance behind the reflector (1) that can be selected by moving the second U-shaped profile part (7). The reflector (1) incorporates an opening (2), through which the halogen bulb (4) extends into the reflector space (20). The cross-section of the opening (2) is a multiple of the cross-section of the halogen bulb, so that a broad annular gap (21) for air circulation is left unobstructed between the halogen bulb (4) and the opening edge (9) of the reflector (1). The support (6, 7) is completely open to the rear and in addition on two opposing sides so as to form an air circulation space (22). The halogen bulb holder (3) is freely supported by the support (6, 7) in the air circulation space (22) that is adjacent to the annular gap (21), so that the air that flows through the annular gap (21) passes around the holder (3) and the base (foot) of the halogen bulb is cooled thereby. This increases the service life of the haolgen lights to a considerable extent.

8 Claims, 1 Drawing Sheet

BULB AND REFLECTOR ASSEMBLY

Figure 1:
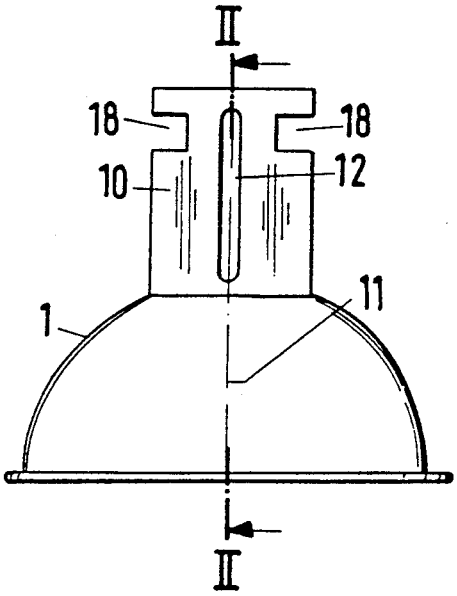

The present invention relates to a light, in particular, a halogen light.

In lights of this kind that are known from practice, there is a massive mounting for the bulb holder and the reflector that is arranged at a distance from it. The diameter of the opening within the reflector is very slightly larger than the diameter of the cylindrical halogen bulb, in order that this can just fit through the opening or the reflector can just slide over the bulb and screwed onto the mounting, and so that as much as possible of the total radiation from the bulb is reflected forwards by the reflector and no heat (thermal radiation, or hot air) can pass back from the bulb.

In a light that is described in DE-A-37 10 147, within a cylindrical housing that is closed off by means of a spherical top portion, there is a bulb holder support in the form of a pot that is open at the bottom, the bulb holder being secured to the bottom of this pot. The bulb holder support is installed within the housing so as to be axially movable by means of a threaded ring. A glass reflector is secured to the spherical top portion by means of screws and mounting springs. The reflector itself incorporates an opening, the diameter of which is slightly larger than the diameter of the head of the bulb, so that the head of the bulb can be moved through the opening with the help of the axially movable bulb holder support.

Lights of another sort that do not incorporate a reflector are known from US-A-3 694 649, US-A-1 825 641 and FR-A-1 021 064.

Earlier halogen lights, which were usually operated at a voltage of 12 Volts and 50–75 Watts have service lives which fall a long way short of the service life that one could actually expect from halogen lights.

It is the task of the present invention to extend the service life of the lights.

According to the present invention, the solution to this task is the object of the patent claim 1. This proceeds from the knowledge that reduced service life is caused by a heat build-up that occurs in the area of the holder of the halogen bulb (at the halogen bulb base or foot).

Proceeding from this knowledge, the present invention teaches that the cross-section of the opening in the reflector be increased to a multiple of the cross-section of the bulb, so that a broad annular gap for the passage of air is opened up between the bulb and the edge of othe opening in the reflector; in order to form space for air to circulate, the support is left open at the back and/or sides and the bulb holder is held freely in the air circulation space that is adjacent to the annular gap, so that a stream of air flows around the bulb holder from the annular gap.

The present invention also teaches the opposite to what has been done in the past: not to prevent the fact that light and thermal radiation (such as hot air) pass to the rear from the bulb, but rather—whilst accepting greater radiation of light and heat to the rear—that the air that is heated by the bulb be used as cooling air for the bulb holder and thus for the base of the bulb, i.e., to use the broad annular gap and the support space to form an air circulation space through which the air passes. When this is done, the present invention exploits the fact that although the air that is heated by the bulb is warmer than the ambient air, it is significantly cooler than the temperature of 120° C. that is still not critical for the life of the halogen bulb, and that the cooling of the bulb holder achieved thereby exceeds the increased heating of the holder that results from increasing the size of the opening and which is caused by the thermal radiation that is passed back through the opening to the holder.

In the present invention, in addition to the broad annular gap, it is important that the bulb holder be secured freely in the air circulation space that is preferably completely open at the top and largely open at the sides, so that the air passes around it. Were the holder to be arranged on the bottom of a pot-like bulb-holder support, as is the case in DE-A-37 10 147, this would cause a heat build-up and, in the case of an enlarged opening in the reflector, would heat the holder to an even greater extent than is the case with conventional halogen lights because of the increased thermal radiation to the rear.

Figure 4:
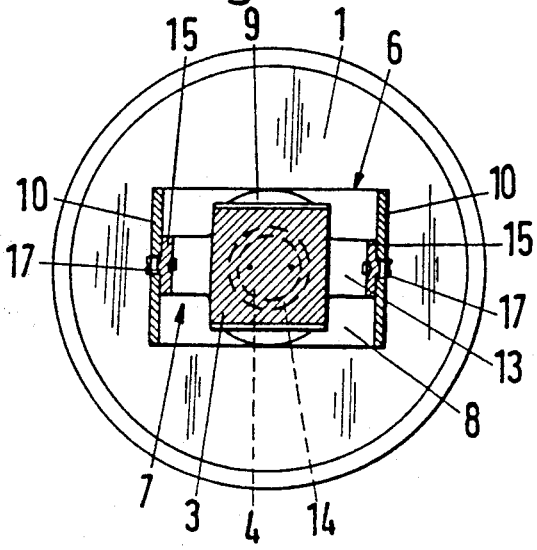
Figure 2:
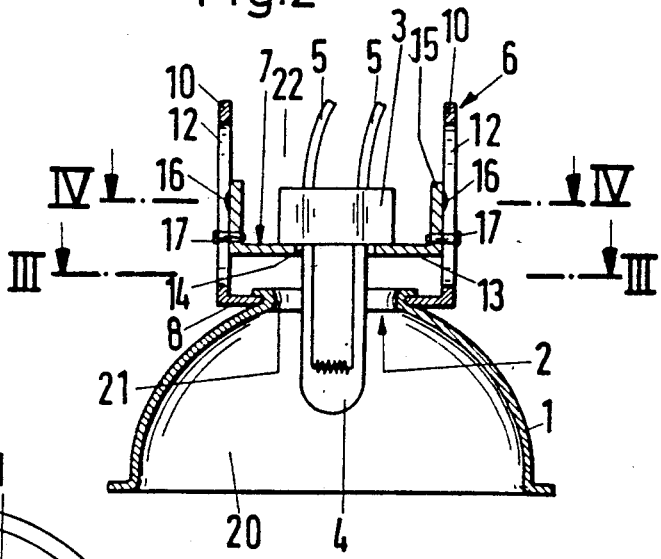
Figure 3:
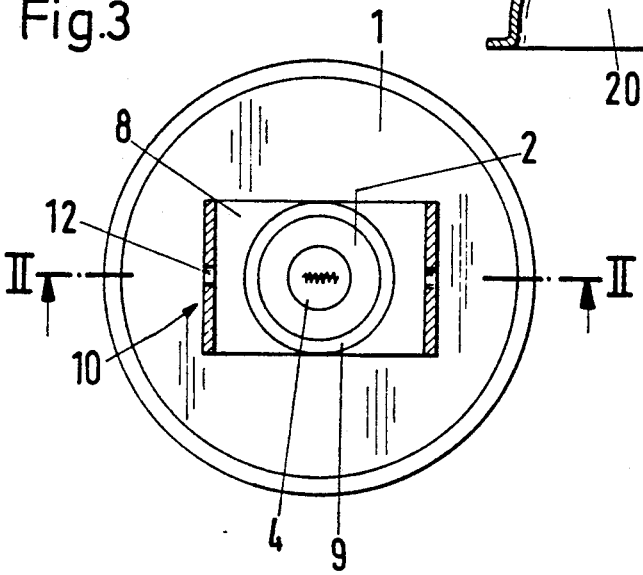

An embodiment of the present invention is described in greater detail below on the basis of the drawings appended hereto. These drawings show the following:

FIG. 1: a side view of a light as viewed in the direction indicated by the arrow 1 in FIG. 3;

FIG. 2: an axial longitudinal cross-section through the light, on the line II—II in FIG. 3;

FIG. 3: an axial cross-section through the light on the line III—III in FIG. 2;

FIG. 4: an axial cross-section through the light on the line IV—IV in FIG. 2.

The light has a hemispherical reflector 1 that is of metal, with a large opening 2 that is obtained by separation of a cap. The reflector 1 and the holder 3 of a halogen bulb 4, the current supply lines for which are numbered 5, are supported by a holder that is made up of two U-shaped profiled parts 6, 7. The first U-shaped profile part 6 is secured to the rear of the reflector 1. Within its cross piece 8 there is a hole that matches the opening 2 in the reflector 1, and the edge of the opening 9 in the reflector 1 is beaded around the edge of the hole. In the two arms 10 of the first U-shaped profile part 6 that extend to the rear, there is in each instance a slot 12 that extends parallel to the axis 11 of the reflector 1 and to the side edges of the arms 10.

The bulb holder 3 is secured to the cross piece 13 of the second U-shaped profile part 7 on the side that is remote from the reflector 1. At its centre, the cross piece 13 has an opening 14 through which the neck of the halogen bulb can pass, and the diameter of this is configured so as to be correspondingly large and matched to the size of the holder 3. The two arms 15 of the second U-shaped profile part 7 lie on the inner side of the arms 10 10 of the first U-shaped profile part 6, and each has a lug 16 that extends outwards and engages in the slots 12, and threaded holes for screws 17 that pass through the slots 12 and connect the U-shaped profile part 7 securely with the arms 10. Because of the lugs 16 that simplify assembly and form a guide, and the screws 17 that pass through the slots 12, the two arms 15 are supported so as to be able to slide in the two slots 12 such that they can be fixed in the desired position on the edges of the slots, so that the depth to which the halogen bulb 4 extends into the reflector 1 can be adjusted as required. The lugs 16 and the screws 17 are arranged axially one behind the other, so that parallel guidance of the second U-shaped profile part 7 is achieved when it is moved along the slots 12 and it is ensured that the axis of the halogen bulb 4 remains on the axis 11 of the reflector 1.

The arms 10 of the first U-shaped profile part 6 have two opposing recesses 18 close to their rear ends, on which the support for the reflector 1 and the holder 3 that is formed by the two U-shaped profile parts 6, 7 can be installed on a suitable mounting. As an example, retaining springs by means of which the holder can be installed in a lamp mounting or housing can be attached to the recesses 18.

The reflector 1 and the two U-shaped profile parts 6 and 7 are preferably of aluminum. In the embodiment shown in the drawing, the hemispherical reflector is of a diameter of 60 to 65 mm. A cap or cup has been separated from this at a height of 2 to 4 mm, this resulting in an opening 2 with a diameter of approximately 20 mm, through which a halogen bulb 4 that is approximately 10 mm in diameter, and which is cylindrical, extends. The diameter of the opening 2 is thus approximately twice as large as the diameter of the (cylindrical) halogen bulb 4; the cross-section (the cross-sectional area) of the opening 2 thus amounts to approximately four times the cross-section of the halogen bulb, and the cross-section of the annular gap 21 that is formed between the halogen bulb 4 of the edge of the opening 2 in the reflector 1 is approximately three times the cross-section of the halogen bulb. The cross-section of the opening 2 could amount to another multiple of the cross-section of the halogen bulb, which could be either twice as great or more than four times as great, in which connection a broad annular gap 21 is essential for cooling the holder 3 and for this reason is preferably at least four times as great. In the case of bulbs with an axially curved head, the cross-section of the opening 2 (i.e. the area enclosed by the edge 9) should be many times greater than the maximum cross-sectional range of the head portion of the bulb that passes into the area of the opening 2 when the U-shaped profile part 7 is moved axially. The holder 3 can also be arranged so as to be immoveable (fixed) in the support 6, 7 when in this case the cross-section of the opening 2 should be at least double and preferably at least four times as great as the cross-section of the part of the bulb that is located in the area of the opening.

The holder 3 is supported completely freely in the centre of the holder that consists only of the two U-shaped profile parts 6, 7, by the cross piece 13, in the air circulation space 22 between the two arms 10. The air circulating space 22 to which the broad annular gap 21 opens out for air circulation, and is thus completely open at the top, and at the sides is defined only by the two arms 10, on which both intervening sides are thus completely open and—since the space between the arms 10 is greater than the diameter of the opening 2—extends radially outwards relative to the annular gap 21.

The bulb holder 3 that is supported freely within the air circulation space 22 is surrounded by air that is heated by the bulb 4 in the reflector space 20 and which rises through the annular gap 21, and is thus cooled thereby (if the light is oriented upwards as opposed to downwards, this air circulation will be reversed). Thus, there is an exchange of air that has been greatly heated by the socket (foot) of the halogen bulb or the holder 3 with the rising air. It has been shown that the base of the halogen bulb 4 that is located in the holder 3 is either not heated above 120° C. or is heated only slightly above this temperature, despite this heating by the thermal radiation that is reflected back through the opening from the head of the bulb 4 that is located in the reflector 1. The ventilation effect and the cooling are naturally particularly effective and intensive if the light is suspended vertically. However, a good effect is also achieved in other positions.

What is claimed:

1. A light, comprising a bulb (4), a bulb holder (3) having wiring points, a reflector (1), and a support (6, 7) for said reflector (1) and said bulb holder (3), said reflector (1) surrounding a reflector space (20) and incorporating an opening (2) with an opening edge (9), said support (6, 7) having means (18) adapted to be attached to a mounting, said support consisting of a U-shaped part (6) and a carrier (7) for said bulb holder (3), said U-shaped part (6) having two arms (10) and a cross piece (8), said cross piece (8) having a hole with a hole edge, said opening edge (9) of said reflector (1) being fitted in said hole edge, said bulb (4) connected in said bulb holder (3) and extending through said hole into said reflector space (20) and the cross-section of said hole being a multiple of the cross-section of said bulb, so that a broad annular gap (21) for the circulation of air is provided between said bulb (4) and the reflector opening edge (9) fitted in the hole edge, said carrier (7) being fastened to said two arms (10), and said bulb holder (3) being carried by said carrier (7) with said wiring points being accessible from the top of said support (6, 7) opposite said reflector (1).

2. A light as defined in claim 1, including an air circulation space (22) formed in the support (6, 7) which extends outwardly relative to the annular gap (21) and is completely open both at the top and on two opposing sides of said support (6, 7) between said two arms (10).

3. A light as defined in claim 1, wherein the diameter of said hole in said cross piece (8) is at least twice as great as the diameter of the bulb (4).

4. A light as defined in claim 1, in which said reflector (1) has an axis (11), said two arms (10) each having a slot (12) therein that is parallel to said axis (11) of said reflector (1), and means (17) fastening said carrier (7) for said bulb holder (3) to said two arms (10) being movable along the two slots (12) and adapted to be fixable in a selected position on the edges of the slot.

5. A light as defined in claim 4, wherein the carrier is formed by a second U-shaped part (7), said second U-shaped part (7) having two second arms (15) and a second cross piece (13), said second arms (15) lying on the inside of the arms (10) of the first mentioned U-shaped part (6), and said means (17) fastening said carrier (7) comprising screws (17) connected with said second arms (15) that pass through the slots (12), said second cross piece (13) having an inside surface supporting said bulb holder (3) and having a second hole (14) through which the bulb (4) passes.

6. A light as defined in claim 5, in which said second arms (15) of the second U-shaped part (7) incorporate lugs (16) that extend outwards and engage in the slots (12).

7. A light as defined in claim 1, in which said reflector (1) is of metal, and the opening edge (9) of the reflector (1) is beaded around the edge of the hole provided in the cross piece (8) of the U-shaped part (6).

8. A light as defined in claim 1, in which said means (18) on said support (6, 7) adapted to be attached to a mounting comprise two recesses (18) that are opposite each other on each of said two arms (10) of said U-shaped part (6) adapted for installation of said support (6, 7).

* * * * *